US008021119B2

(12) United States Patent
Wang

(10) Patent No.: US 8,021,119 B2
(45) Date of Patent: Sep. 20, 2011

(54) LOCKING PLATE FAST FASTENING CEILING FAN BLADES

(75) Inventor: Cliff Wang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 392 days.

(21) Appl. No.: 12/436,213

(22) Filed: May 6, 2009

(65) Prior Publication Data

US 2010/0284813 A1 Nov. 11, 2010

(51) Int. Cl.
*F04D 29/36* (2006.01)

(52) U.S. Cl. ..... 416/206; 416/210 R; 416/220 R

(58) Field of Classification Search ..... 416/206, 416/210 R, 220 R
See application file for complete search history.

(56) References Cited

U.S. PATENT DOCUMENTS

| | | | | |
|---|---|---|---|---|
| 6,821,091 | B2 * | 11/2004 | Lee | 416/210 R |
| 7,351,037 | B1 * | 4/2008 | Mares et al. | 416/210 R |
| 2004/0151589 | A1 * | 8/2004 | Cortez et al. | 416/210 R |
| 2004/0219023 | A1 * | 11/2004 | Bird et al. | 416/210 R |

* cited by examiner

*Primary Examiner* — Thanh Nguyen
(74) *Attorney, Agent, or Firm* — Ming Chow; Sinorica, LLC

(57) ABSTRACT

A locking plate fast fastening ceiling fan blades includes a clamp plate. A chute is formed on the clamp plate, where a pushing board is contained. The clamp plate in the chute is provided with a first wedge unit and a thru hole. Thus, when a set of blades is installed on a blade rack of a ceiling fan, only the blade is set around several pillars on the blade rack, the clamp plate of fixing plate is set to locate on the pillar, and a pillar is made to pass through the thru hole. The pushing board of fixing plate is shifted toward the pillar, making the front end of pushing board stay close to the side of pillar and the first wedge unit of clamp plate stay close to the terminal of pushing board for fast and exact completion of fixing of the blade onto the blade rack.

10 Claims, 5 Drawing Sheets

LOCKING PLATE FAST FASTENING CEILING FAN BLADES

BACKGROUND OF THE INVENTION

1. Field of the Invention

This invention relates to a locking plate fast fastening ceiling fan blades.

2. Description of the Prior Art

In order to prevent the fact that the blades of a conventional ceiling fan is collided to deviate the preset angle of the blades, when the blades are shipped, and thus that the installed ceiling fan causes noise and even wobbles when operating, the body of ceiling fan and a blade rack are in advance installed on the ceiling, and then the several blades are locked onto the blade rack of the body, the effects of easy shipment, preservation, and installation being further achievement.

However, the blade of conventional ceiling fan is definitely long as a rule and a front end of the blade is generally locked; it is not easily installed. In order to solve the defects, a locking device fastening the ceiling fan blades as disclosed in U.S. Pat. No. 6,652,236 is developed in the market. In this disclosure, the device is mainly provided with a clamp plate. Several apertures are formed on the clamp plate and an elongate retaining portion is formed around each of the apertures. The elongate retaining portion is connected to each of the opposite apertures. Further, retainer spring tab is provided around one of the apertures on the clamp plate. Thus, at the time of installation, only the apertures of the clamp plate align with and connect to the monitoring posts of a blade rack, the clamp plate is pushed forwards to make the mounting posts locate in the elongate retaining portion, and the retainer spring tab is made to push down one of the mounting posts for completion of fast and exact installation. Further, for example, a locking device fastening the ceiling fan blades, which is disclosed in U.S. Pat. No. 5,593,283 is mainly provided with an annular spider. Four openings are formed at an equal angle around on the spider. The openings are formed with larger openings and smaller openings. Besides, a spring steel lock member is provided covering the opening. Thus, at the time of installation, only the openings of the clamp plate align with and connect to the monitoring posts of the blade rack. Then, the clamp plate is turned counterclockwise to locate the mounting posts in the smaller openings and make the spring steel lock member stay close to the sides of mounting posts for fast completion of installation of the blade.

However, the spring steel lock member of the device fast installed is fixed with rivets on the clamp plate. After it services for a long time, the fixed portion is easily deformed and then a gap is formed, causing the ceiling fan to make noises and wobble when the fan operates, and even seriously making the operating blades fall off during operation because the spring steel lock member has no elasticity; thus, it is apparent that improvement is necessarily made.

Consequently, because of the technical defects of described above, the applicant keeps on carving unflaggingly through wholehearted experience and research to develop the present invention, which can effectively improve the defects described above.

SUMMARY OF THE INVENTION

A locking plate fast fastening ceiling fan blades according to this invention mainly comprises a clamp plate and a pushing board for connecting several pillars of the ceiling fan blades and thus fastening a blade onto the blade rack. On the clamp plate, the pillar opposite to the blade rack is provided with a first nick. A chute is formed in the center of clamp plate, where the pushing board is contained, so that the pushing board may slip in the chute. Further, the clamp plate in the chute is provided with a first wedge unit. The first wedge unit is a first wedge spring plate. One side of the first wedge spring plate is a fixing terminal and connects to the clamp plate; the other side is formed with a free terminal upwards warping toward the pushing board to stay close to the terminal of pushing board. Further, the clamp plate in the chute is formed with a thru hole for allowing one of the pillars on the blade rack. The pushing board opposite to the pillar is formed with a second nick. Thus, only the pushing board is shifted toward the pushing board to wedge the second nick of pushing board to the side of pillar and make the free terminal of first wedge spring plate of the clamp plate stay close to the terminal of pushing board for fast and exact completion of the blade, and the tremble and the wind shear sound caused by the blade not exactly located may be eliminated.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
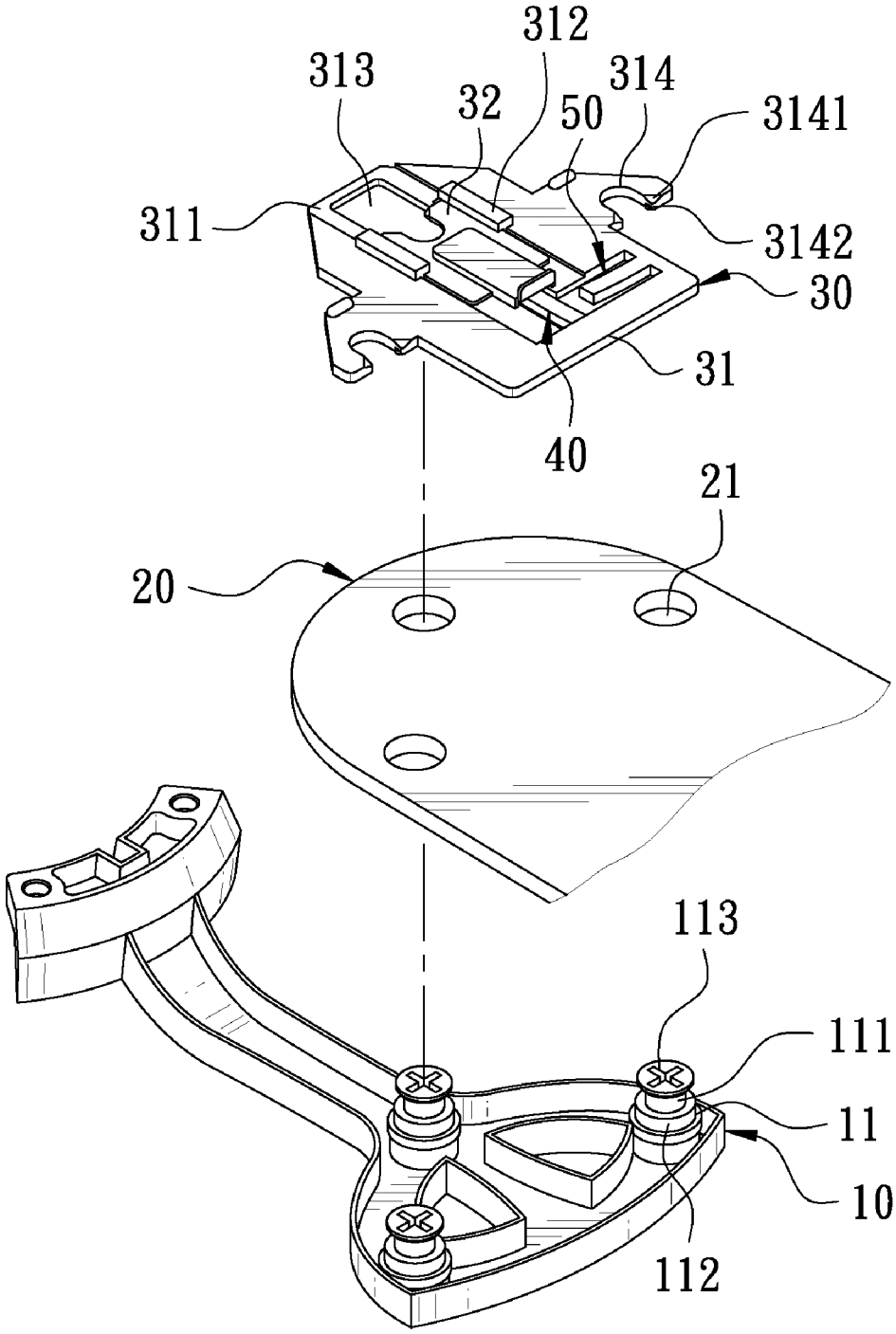
FIG. 1 is a 3D exploded view of a preferred embodiment of the present invention.

With reference to FIG. 1 shown as a 3D exploded view of a preferred embodiment of the present invention, a locking device mainly comprises a blade rack 10, a blade 20, and a fixing plate 30. On the blade rack 10, three triangular pillars 11 are formed. Each of the pillars 11 is formed with a screw bolt 111 and a rubber sheath 112 set around the screw bolt 111 to form on the top of pillar 11 a head 113 of which the diameter is larger than that of pillar 11. On the blade 20 opposite to the pillar 11 of blade rack 10, three thru holes 21 are formed and set around the pillar 11 of blade rack 10 and lie below the head 113 of the pillar 11. Then, the holes 21 are wedged to the side of pillar 11 of the blade rack 10 through the locking plate 30 and located between the blade 20 and the head 113 of pillar 11 for fixing the blade 20 onto the blade rack 10.

Figure 2:
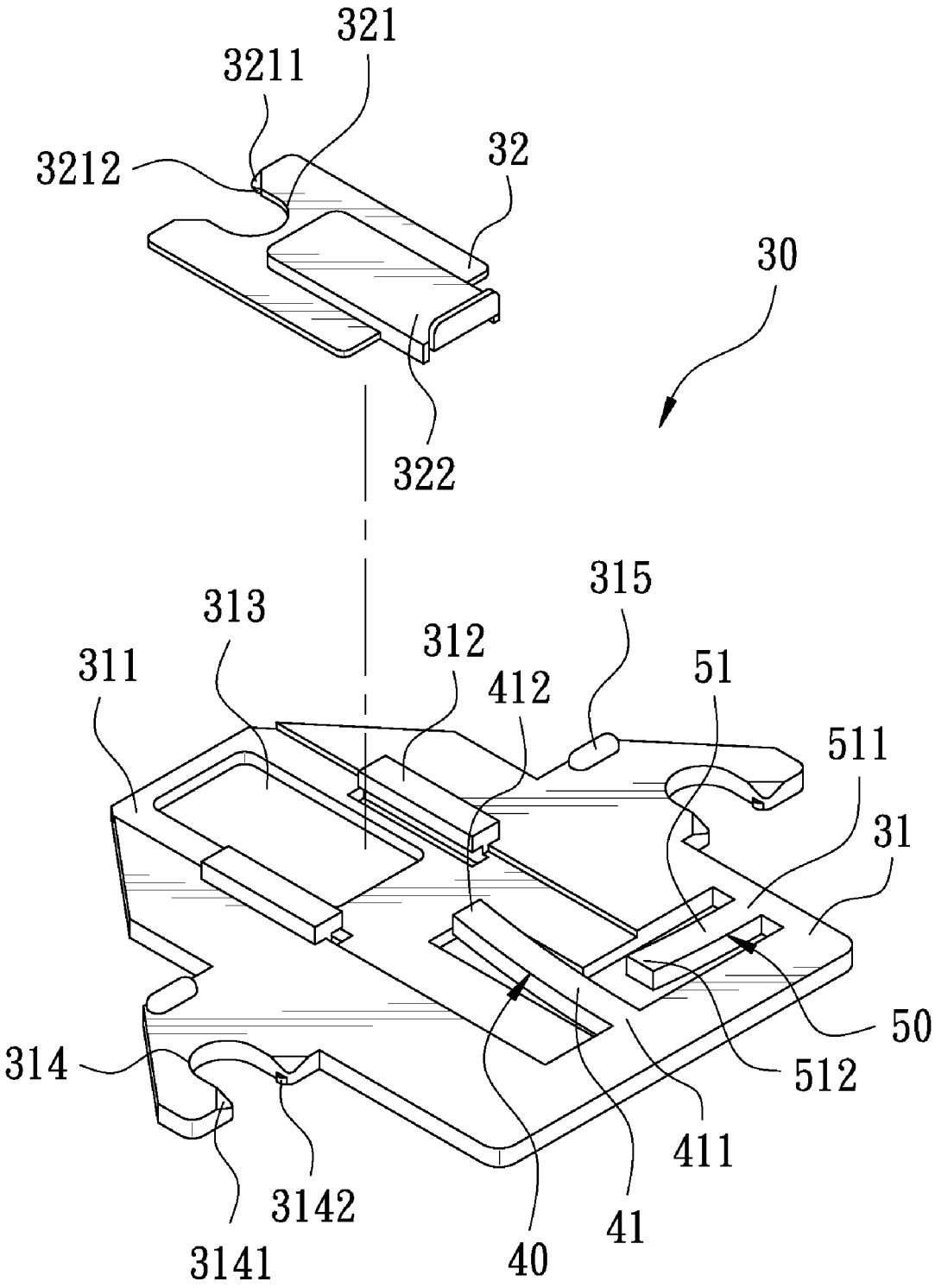
FIG. 2 is a 3D exploded view of a locking plate according to the present invention.

With reference to FIG. 2 shown as a 3D exploded view of a locking plate according to the present invention, the locating plate 30 mainly comprises a clamp plate 31 and a pushing board 32.

A chute 311 is formed in the center of clamp plate 31, where the pushing board 32 is contained, and the pushing board 32 may slip in the chute 311. At two sides of the chute 311, the clamp plate 31 is formed with a stop portion 312 is formed stretching transversally. At the front end of chute, the clamp plate 31 is formed with a thru hole 313, and a second wedge unit 40 and a second wedge unit 50 are provided at the bitter end of the chute 311. The first wedge unit 40 is a first spring plate 41 horizontal to the chute 311. One side of the first wedge spring plate 41 is a fixing terminal 411 and connects to the clamp plate 31; the other side is formed with a free terminal 412 upwards warping toward the pushing board 32 to stay close to the terminal of pushing board 32. The second wedge unit 50 is a second spring plate 51 vertical to the chute 311. One side of the second wedge spring plate 51 is a fixing terminal 511 and connects to a side of clamp plate 31; the other side of the spring plate 51 is formed with a free terminal 512 upwards warping toward the other side of the chute 311. The free terminal 512 may also stay close to the terminal of pushing board 32. Further, the clamp plate 31 is provided with a first nick 314 at two sides of the chute 311, and a first oblique angle 3141 is formed at each of the two opening sides of the first nick 314. The clamp plate is formed with a first stop lump 3142 at a camber formed by the first nick 314 near the first oblique angle 3141. Further, the clamp plate 31 is provided with a lug 315 at two sides of the chute 311 near the first nicks 314.

A second nick 321 is formed at the front end of pushing board 32. A second oblique angle 3211 is formed at each of the two opening sides of the second nick 321 of the pushing board 32, and a second stop lump 3212 is formed at the camber formed by the second nick 321 near the second oblique angles. Further, a convex portion 322 is formed in the center of pushing board 32.

Figure 3:
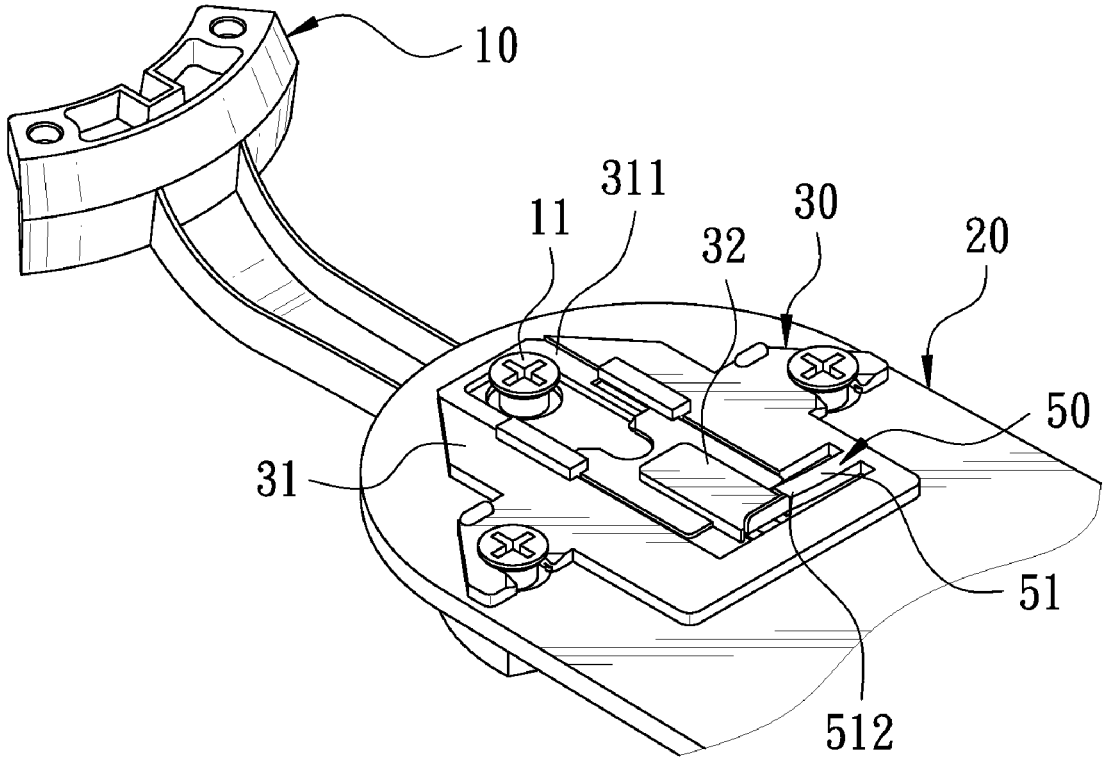
FIG. 3 is a schematic view illustrating a first wedge spring plate of the clamp plate does not pop up.
Figure 4:
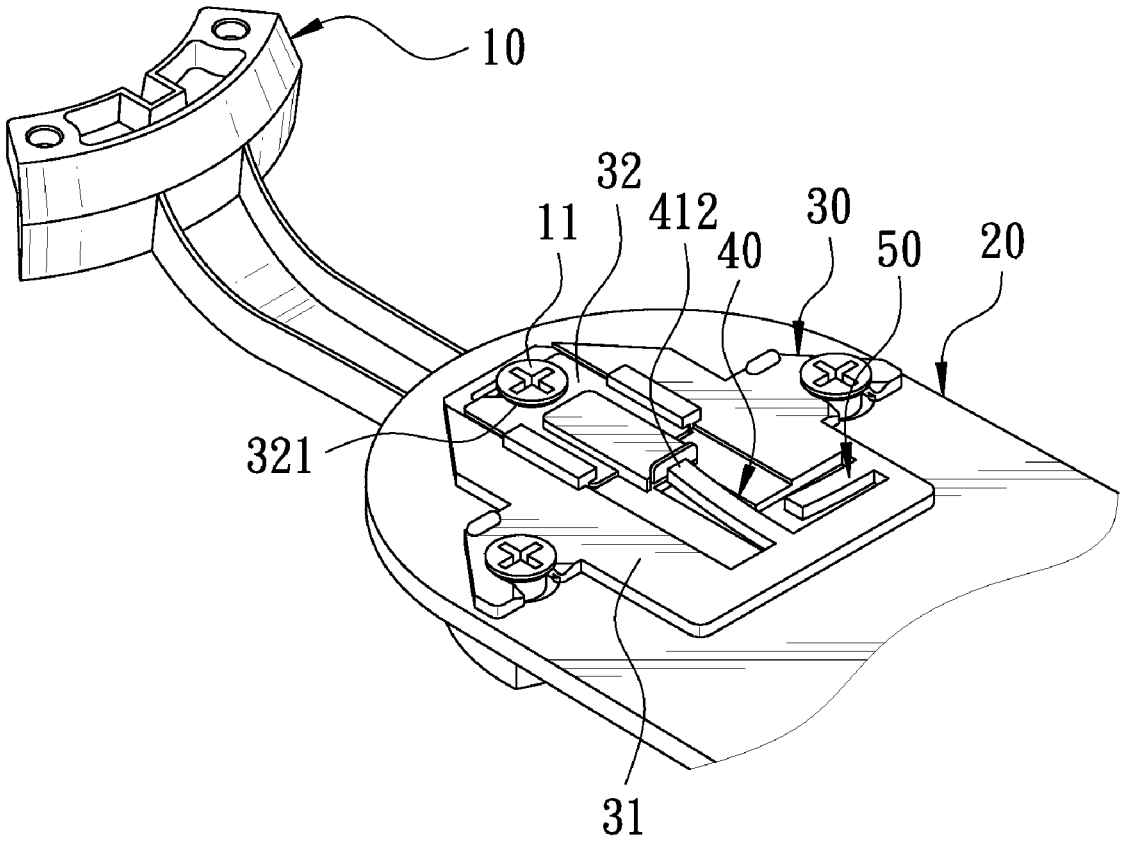
FIG. 4 is a schematic view illustrating the first wedge spring plate of the clamp plate pops up and stays close to the convex portion of the pushing board.
Figure 5:
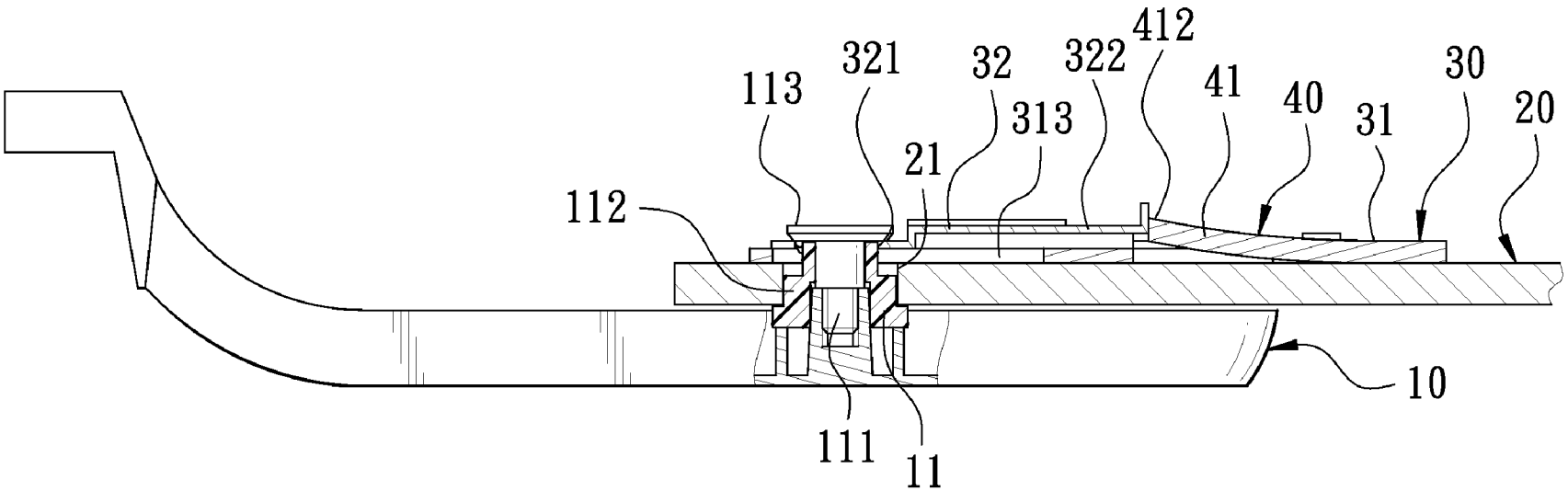
FIG. 5 is a sectional assembly view of the present invention.

Refer to FIGS. 3, 4, and 5 shown as a schematic view illustrating a service state of the present invention, and a sectional assembly view of the present invention. First, the pushing board 32 of fixing plate 30 is located in the chute 311 of clamp plate 31, and the stop portion 312 of clamp plate 31 and the free terminal 512 of second wedge spring plate 51 limiting the position are used to prevent the pushing board 32 from slip away from the chute 311 of clamp plate 31. Thus, at the time of installation, as shown in FIG. 1, the aperture 21 of blade 20 is made to align with and be set around the pillar 11 of blade rack 10, the first nick 314 of clamp plate 31 of the fixing plate 30 is made to align with and wedge to the opposite pillar 11 on the blade rack 10, and the pillar 11 in the center of blade rack 10 is made to pass through the thru hole 313 of clamp plate 31. With the first oblique angle 3141 at the two sides of opening of the first nick 314 of clamp plate 31, the first nick 314 of clamp plate 31 is made to easily wedge forwards to the side of pillar 11 of blade rack 10. With the first stop lump 3142 on the inner wall of first nick 314, the pillars 11 are not easily away from the first nick 314. Then, as shown in FIG. 3, with the convex portion 322 of pushing board 32, the pushing board 32 is shifted towards the pillar 11, and thus as shown in FIG. 4, the first nick 321 of pushing board 32 is made to forwards wedge to the side of pillar 11. Further, as shown in FIG. 5, the free end 412 of first wedge spring plate 41 of the clamp plate 31 is made to pop up and stay close to the bitter end of convex portion 322 of the pushing board 32. The pushing board 32 is thereby blocked from moving to fix the blade 20 onto the blade rack 10. Accordingly, the blade 20 may be fast and exactly installed and the tremble and the wind shear sound caused by the blade not exactly located may be eliminated. Further, to reversely operate and remove the blade 20, only the first wedge spring plate 41 of clamp plate is pressed, and the pushing board 32 of locking plate 30 is made to backwards shift.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A locking plate fast fastening ceiling fan blades, the ceiling fan being provided with several blade racks and each blade rack fixing a blade by wedging a fixing plate, in which several pillars are provided on each blade rack, a head of which the diameter is larger than that of pillar is provided at the top of each pillar, and on the blade opposite to the pillar of blade rack, thru holes are formed and set around the pillar of blade rack, being characterized in that:

the locking plate comprises a clamp plate and at least one pushing board, in which the clamp plate is wedged between the blade and the head of pillar of the blade rack, at least one chute is formed on the clamp plate, where the pushing board is contained, and thus the pushing board slips forwards and backwards in the chute, the clamp plate in the chute is provided with at least one first wedge unit, the first wedge unit is a first spring plate horizontal to the chute, one side of the first wedge spring plate is a fixing terminal and connects to the clamp plate and the other side is formed with a free terminal upwards warping toward the pushing board to stay close to the terminal of pushing board, the clamp plate in the chute is formed with a thru hole for allowing the pillar on the blade rack, and the pushing board slip towards the pillar and stays close to the side of pillar.

2. The locking plate fast fastening ceiling fan blades according to claim 1, wherein a first nick is formed on the clamp plate opposite to the pillar of blade rack.

3. The locking plate fast fastening ceiling fan blades according to claim 1, wherein a first oblique angle is formed at each of the two opening sides of the first nick on the clamp plate.

4. The locking plate fast fastening ceiling fan blades according to claim 3, wherein the clamp plate is formed with a first stop lump at a camber formed by the first nick near the first oblique angle.

5. The locking plate fast fastening ceiling fan blades according to claim 1, wherein a second wedge unit is provided transversally at the bitter end of the chute, the second wedge unit is a second wedge spring plate, one side of the second wedge spring plate is a fixing terminal and connects to a side of the chute, and the other side is formed with a free terminal upwards warping toward the chute to stay close to the terminal of pushing board.

6. The locking plate fast fastening ceiling fan blades according to claim 1, wherein the clamp plate in the two sides of the first chute is provided with several lugs.

7. The locking plate fast fastening ceiling fan blades according to claim 1, wherein the front end of pushing board opposite to the convex portion in the thru hole on the clamp plate is formed with a second joint slot.

8. The locking plate fast fastening ceiling fan blades according to claim 7, wherein a second oblique angle is formed at each of the two opening sides of the second nick on the pushing board.

9. The locking plate fast fastening ceiling fan blades according to claim 8, wherein the pushing board is formed with a second stop lump at a camber formed by the second nick near the second oblique angle.

10. The locking plate fast fastening ceiling fan blades according to claim 1, wherein at least one convex portion is formed at the bitter end of pushing board.

* * * * *